US008674270B2

(12) United States Patent
Anderson et al.

(10) Patent No.: US 8,674,270 B2
(45) Date of Patent: Mar. 18, 2014

(54) COOKING APPLIANCE WITH PROGRAMMABLE RECIPE SYSTEM

(75) Inventors: John R. Anderson, Stevensville, MI (US); Jennifer L. Bonuso, Saint Joseph, MI (US); Brandon L. Satanek, Stevensville, MI (US); Steven M. Swayne, Chattanooga, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 944 days.

(21) Appl. No.: 12/641,427

(22) Filed: Dec. 18, 2009

(65) Prior Publication Data

US 2011/0151072 A1 Jun. 23, 2011

(51) Int. Cl.
*H05B 3/68* (2006.01)
*A21B 1/00* (2006.01)

(52) U.S. Cl.
USPC ..... 219/448.12; 219/391; 219/447.1

(58) Field of Classification Search
USPC ..... 219/391, 447.1, 448.12
See application file for complete search history.

(56) References Cited

U.S. PATENT DOCUMENTS 4,695,711 A * 9/1987 McGeorge ..... 219/506
5,528,018 A 6/1996 Burkett et al.
5,877,477 A * 3/1999 Petty et al. ..... 219/506
6,080,972 A * 6/2000 May ..... 219/494
6,252,206 B1 6/2001 Leukhardt, III et al.
6,255,630 B1 7/2001 Barnes et al.
6,710,308 B2 3/2004 Sauter et al.
6,750,433 B2 6/2004 Guenther et al.
6,759,637 B2 * 7/2004 Kim ..... 219/702
6,809,301 B1 10/2004 McIntyre et al.
6,933,477 B2 * 8/2005 Becker et al. ..... 219/506
6,967,314 B2 11/2005 Sauter et al.
8,419,434 B2 * 4/2013 Do et al. ..... 434/127
2003/0000947 A1 * 1/2003 Kim ..... 219/702
2005/0218139 A1 10/2005 Cavada et al.
2007/0158335 A1 * 7/2007 Mansbery ..... 219/505
2007/0278219 A1 * 12/2007 Claesson et al. ..... 219/702
2009/0188396 A1 * 7/2009 Hofmann et al. ..... 99/342
2010/0140248 A1 * 6/2010 Yi et al. ..... 219/391
2010/0187224 A1 * 7/2010 Hyde et al. ..... 219/720
2011/0089158 A1 * 4/2011 Satanek ..... 219/506
2011/0114620 A1 * 5/2011 Lommel et al. ..... 219/209

* cited by examiner

*Primary Examiner* — James Mitchell

(57) ABSTRACT

A cooking appliance includes an oven cavity and a control system having a control display adapted to display an interactive sequence of display screens through which a user enters a cooking recipe. The sequence of display screens includes a cooking mode selection screen, a cooking temperature selection screen, a cooking monitoring selection screen from which a user selects from a probe monitoring process or a timer monitoring process, and a review screen for prompting the user to review the cooking mode, cooking temperature, and method of monitoring selections. The system allows a user to add additional stages to create a multi-stage recipe.

11 Claims, 7 Drawing Sheets

COOKING APPLIANCE WITH PROGRAMMABLE RECIPE SYSTEM

BACKGROUND OF THE INVENTION

1. Field of the Invention

The present invention pertains to the art of cooking appliances and, more particularly, to a cooking appliance including a user interface and control system for initiating and controlling a cooking operation based on an established and saved recipe.

2. Description of the Related Art

Over the years, there have been many advances in the art of cooking appliances. Various heat sources, such as convection air, microwave and IR heating elements have been used, in one way or another, to perform cooking operations. Mechanical components such as switches, thermostats and other controls have been replaced, or at least supplemented, by electronic control systems. Rotary knobs are slowly giving way to touch pads and touch screen displays. Many new features have been added to the cooking appliance, such as pre-programmed operations, recipes, and multi-stage cooking operations. Many ovens, ranges and the like available on the market today incorporate, to certain degrees, programmable features intended to aid a consumer in performing cooking operations. Some electronic control systems for cooking appliances enable a consumer to input certain cooking information, such as cooking modes, times and temperatures, with the inputted information generally being presented in a viewable display area and used to establish a cooking operation.

As set forth above, there have been various developments in the art of cooking appliances directed to aiding a consumer in performing certain cooking operations effectively. However, there still exists a need for a more user friendly system for controlling the operation of a cooking appliance. More specifically, there exists a need for an electronic control system which functions to prompt a user, as needed, to input certain cooking information in a convenient and clear manner, and then automatically controls the cooking appliance to perform the desired operation, including a temperature probe mode of operation. In addition, there is a need for an oven that is capable of being programmed to perform various operations in a desired manner, such as following a personal recipe, possible having multiple stages, stored in the system by the user.

SUMMARY OF THE INVENTION

The present invention is directed to a system and method of controlling a cooking appliance, in particular operating an oven based on a saved cooking recipe. The cooking appliance includes an oven cavity adapted to be used in cooking foods and a control system that includes a control display adapted to display an interactive sequence of display screens through which a user can enter a recipe. The sequence of display screens includes a cooking mode selection screen, a cooking temperature selection screen, a cooking monitoring selection screen from which a user selects from a probe monitoring process or a timer monitoring process, and a review screen for prompting the user to review the cooking mode, cooking temperature and method of monitoring selections. A user may also add additional stages to create a multi-stage recipe.

Additional objects, features and advantages of the present invention will become more readily apparent from the following detailed description of preferred embodiments of the invention when taken in conjunction with the drawings wherein like reference numerals refer to corresponding parts in the several views.

DETAILED DESCRIPTION OF THE PREFERRED EMBODIMENTS

Figure 1:
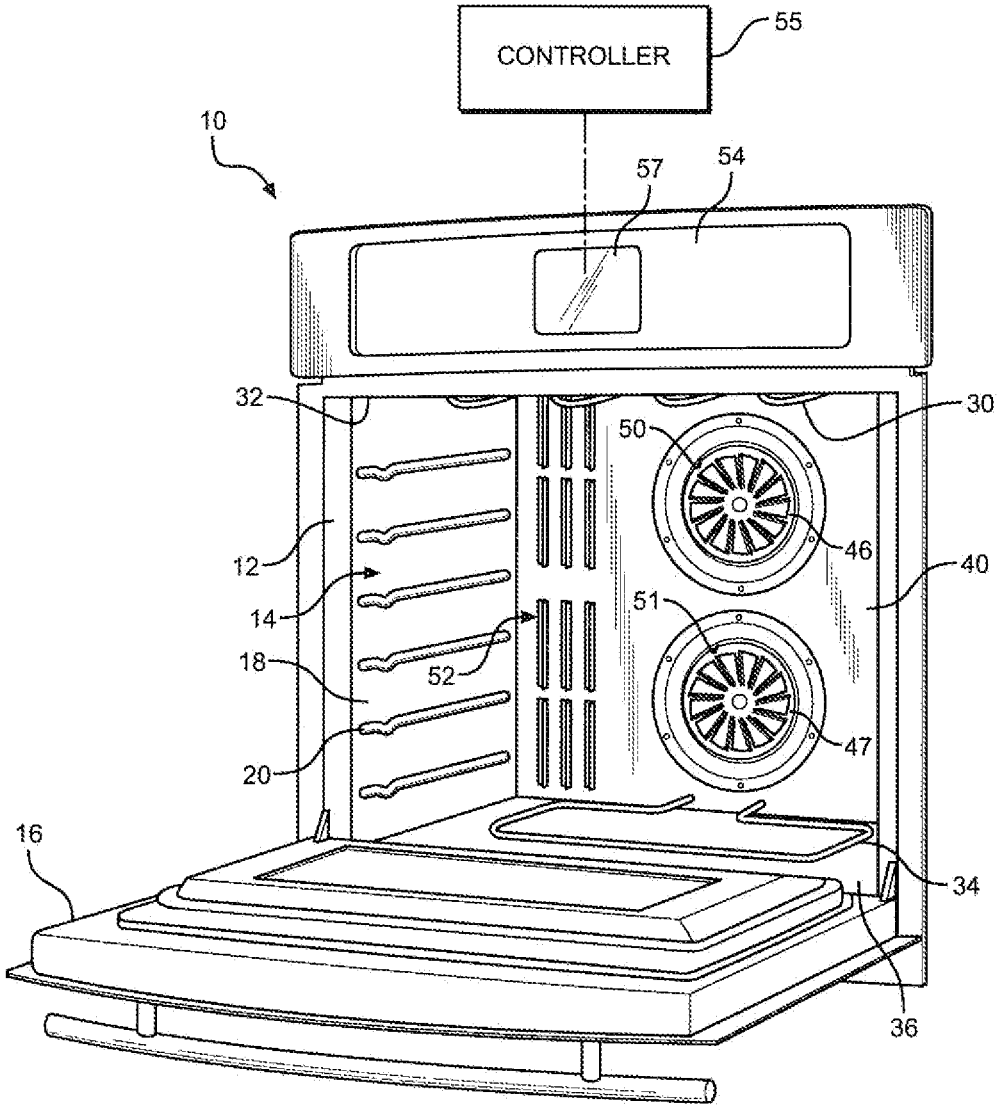
FIG. 1 is a perspective view of a cooking appliance including controls in accordance with the present invention.

With initial reference to FIG. 1, a combination radiant heat and convection oven is generally indicated at 10. In the preferred embodiment shown, oven 10 is a wall-mounted or built-in oven, and includes a cabinet 12 which forms an oven cavity 14. A door 16 is pivotally mounted to cabinet 12 for selectively closing oven 10 and sealing oven cavity 14. Oven cavity 14 includes opposing side walls 18 having a plurality of spaced rails 20 for supporting repositionable racks (not shown) in a manner known in the art.

Oven 10 also includes a plurality of heating elements. More specifically, oven 10 includes an upper broil element 30 mounted adjacent an upper wall 32 of oven cavity 14 and a lower bake element 34 mounted adjacent a lower wall 36 of oven cavity 14. Upper broil element is constituted by a 3600 watt resistive-type electric heating element, while lower bake element 34 is constituted by a 2800 watt resistive-type electric heating element. A convection cover 40 is adapted to be mounted over first and second motor driven fans 46 and 47 within oven cavity 14 as will be discussed more fully below. Fans 46 and 47 are constituted by multi-speed electric fans which can be continuously operated or pulsed. Fans 46 and 47 are centrally mounted and vertically arranged within oven cavity 14, such that first and second fans 46 and 47 are aligned with and positioned at respective first and second circular apertures 50 and 51 formed in convection cover 40. Convection cover 40 also includes a plurality of spaced angled louvered openings 52 on either side of first and second fans 46 and 47, with louvered openings 52 being adapted to distribute heated air evenly throughout oven cavity 14. The details of oven 10 are for illustrative purposes only. In general, the present invention is directed to a user interface 54 arranged in communication with a controller 55, and is not meant to be limited for use with any particular oven.

Figures 2A, 2B:
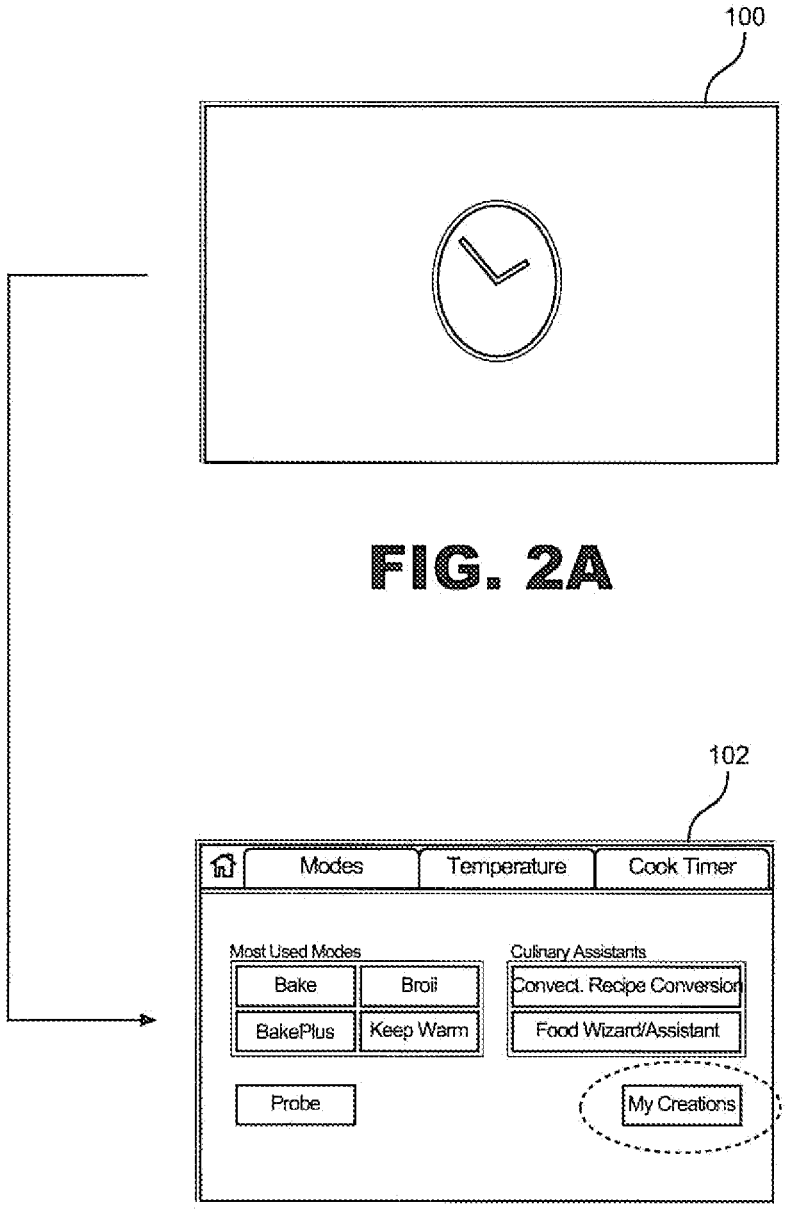
FIG. 2A is a plan view of an initial clock screen employed in the cooking appliance of FIG. 1.
FIG. 2B is plan view of an Initial Selection screen of the present invention.

In accordance with the present invention, interface 54 includes a control display 57 that allows a user to input and store information based on prompts from a sequence of display screens. In the embodiment shown, control display 57 is constituted by a 7-inch LCD touch screen. Control display 57 is adapted to display a plurality of user interface screens including an initial clock screen 100 and an Initial Selection screen 102 depicted in FIGS. 2A and 2B respectively. As illustrated in FIG. 2B, the invention provides for at least a bake mode, a broil mode, a no preheat one-rack bake mode (BakePlus), a convection mode and a warming mode. As will be detailed more fully below, a particular aspect of the present invention is directed to the manner in which oven 10 is programmed and operated by prompting a user for specific information using a "My Creations" mode.

The manner in which oven 10 is programmed using the "My Creations" mode will now be described with reference to FIGS. 2A-11. When oven is not in use, display 57 may show an initial screen 100 that is a view of a clock, graphically represented in FIG. 2A. A user activates interface 54 by touching screen 100. As shown, when interface 54 is activated, screen 100 changes to Initial Selection screen 102, as shown in FIG. 2B, which presents various operating options for oven 10. With screen 102 being displayed, a user can select a desired operating command by simply touching a portion of screen 102 in which a keyword is indicated. As shown, the user can preferably select between "Bake", "BakePlus", "Broil", "Keep Warm", "Probe", "Convection Recipe Conversion", "Food Wizard/Assistant" or "My Creations". Other keywords may be displayed based on the modes the user most often employs. Further details of the operation of oven 10 upon selecting the "My Creations" option in accordance with the invention will be presented more fully below.

Figure 3:
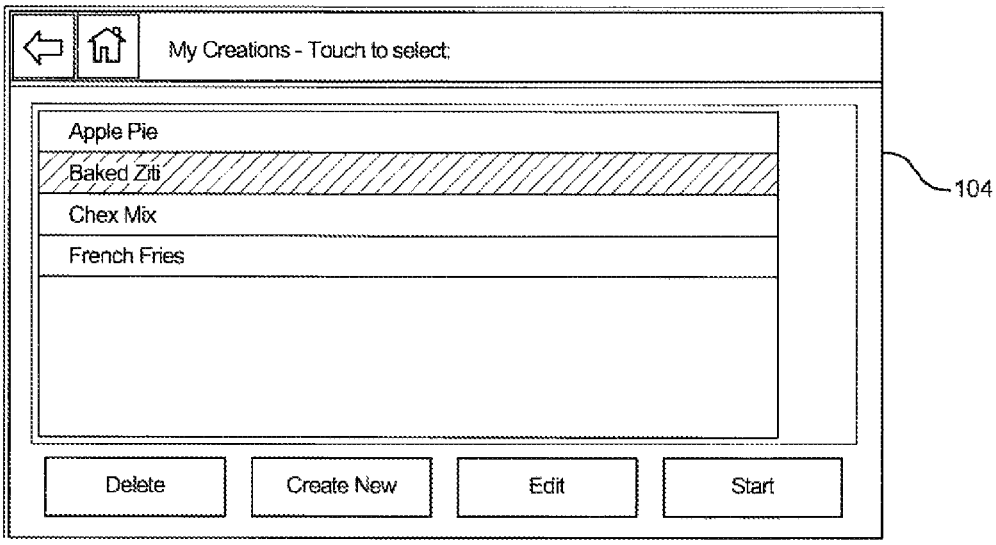
FIG. 3 is a plan view of a My Creations screen in accordance with the present invention.

Once the "My Creations" option is selected, display 57 automatically shifts to a "My Creations" screen 104, as shown in FIG. 3, wherein a user is prompted to select a stored recipe or to create a new recipe by selecting "Create New". For exemplary purposes, the stored recipes may include "Apple Pie", "Baked Ziti", "Chex Mix" and "French Fries". The user may also Delete, Edit or Start an existing stored recipe by selecting the appropriate command. If a stored recipe is selected to "Start", the oven commences the cooking operation according to previously entered parameters. If the user selects "Delete", the selected recipe will be removed from the list of recipes. If "Edit" is selected, screen 104 shifts to a Review screen, which will be described in detail with reference to FIG. 9.

Figure 4:
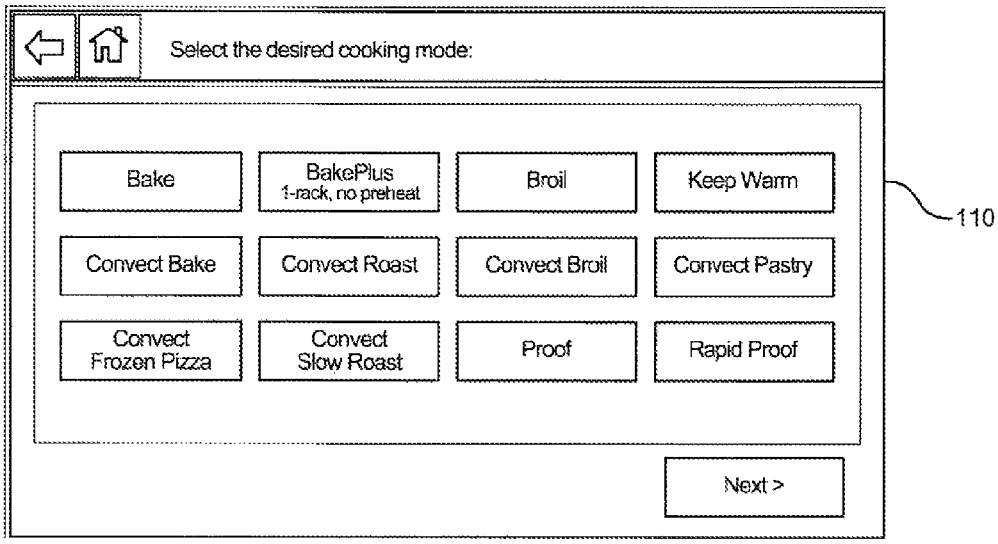
FIG. 4 is a Cooking Mode Selection screen.
Figure 5:
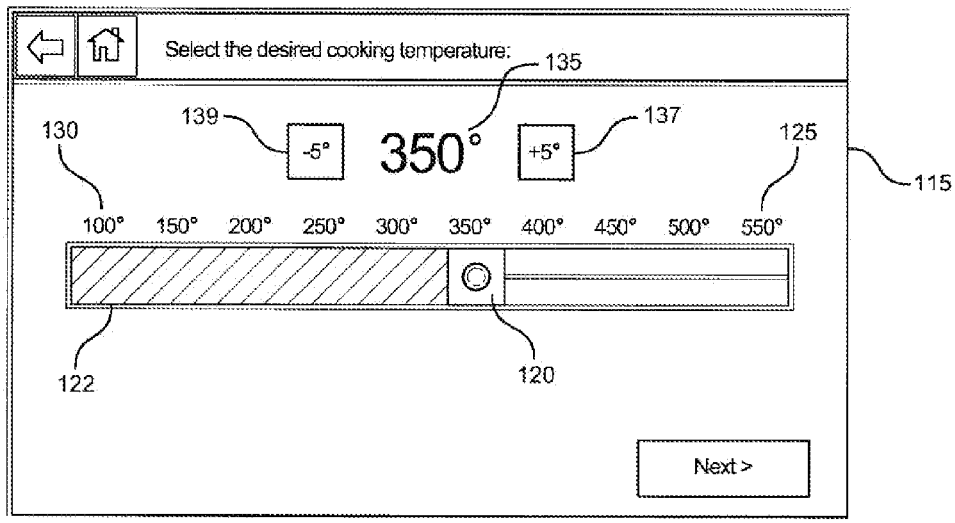
FIG. 5 is a plan view of a Temperature Selection screen of the present invention.

If the user selects "Create New", screen 104 shifts to Cooking Mode Selection screen 110, as depicted in FIG. 4. From screen 110, the user may select from a variety of cooking modes. As shown, the user can preferably select "Bake", "BakePlus", "Broil", "Keep Warm", "Convect Bake", "Convect Roast", "Convect Broil", "Convect Pastry", "Convect Frozen Pizza", "Convect Slow Roast", "Proof" or "Rapid Proof". Following the selection of a desired cooking mode, the user selects "Next" and screen 110 shifts to Temperature Select screen 115, as illustrated in FIG. 5.

In accordance with the present invention, Temperature Select screen 115 includes a virtual slide bar 120 adapted to be positioned by a user at various points along the length of a virtual track 122. Virtual track 122 includes temperature indicia 125 located at intervals along track 122. Temperature indicia 125 are preferably in the form of a digital temperature display 130 which generally span the temperature range of oven 10. For example, as depicted in FIG. 5, digital temperature display 130 includes temperature indicia 125 between 100° F. and 550° F. Temperature Select screen 115 further includes a text display 135 adapted to digitally display a selected cooking temperature. Also provided is a first virtual toggle button 137 adapted to adjust the temperature of a cooking cycle by a positive set temperature increment upon selection of the first toggle button 137 and a second virtual toggle button 139 adapted to adjust the temperature of the cooking cycle by a negative set temperature increment upon selection of the second virtual toggle button 139. In the embodiment shown in FIG. 5, for example, toggle buttons 137 and 139 are set at 5° F. increments.

When a user desires to set a temperature for a cooking cycle, the user can adjust the temperature in one of three ways. First, a user may touch control display 57 at slide bar 120 and slide his/her finger across track 122 until slide bar 120 is positioned at a desired temperature. As slide bar 120 slides along track 122, the corresponding temperature displayed on text display 135 adjusts automatically so that a user can quickly and easily identify the position of slide bar 120 on track 122. Another way in which a user may select a temperature is by touching an empty portion of track 122 at a desired location based on temperature indicia 125. Slide bar 120 will automatically move to the location selected by the user. Optionally, slide bar 120 may be adapted to snap to the nearest temperature indicia 125 on track 122. Another way in which a user may set a desired cooking temperature is by touching virtual toggle buttons 137 and 139, which will automatically move slide bar 120 along track 122 while displaying the chosen temperature on text display 135. During the cooking cycle, controller 55 controls the operation of one or more of heating elements 30, 34 based on the temperature selected. Additional details of the slide control settings can be found in co-assigned U.S. patent application entitled "Sliding Control System for Cooking Appliance" application Ser. No. 12/560,461 filed on Sep. 16, 2009, herewith and incorporated herein by reference.

Figure 6:
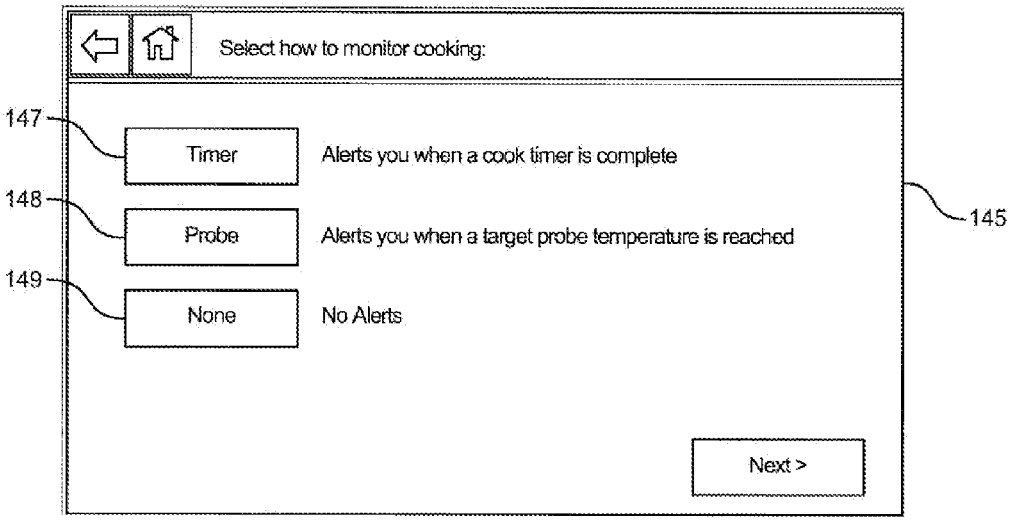
FIG. 6 is a plan view of a Monitoring Method Selection screen of the invention.

Following the selection of the desired cooking temperature, a user selects "Next" on screen 115 and display 57 shifts to Cooking Monitoring Selection screen 145, as shown in FIG. 6, whereupon display 57 prompts the user to select the desired method of monitoring the cooking process. As shown, the user may select "Timer" 147, "Probe" 148 or "None" 149. If "Timer" 147 is selected, the user will be notified when a time period set on a cooking timer has lapsed. If "Probe" 148 is selected, the user will be notified when a probe, which is inserted in the food to be cooked, has reached a target probe temperature. If "None" 149 is selected, no notifications will be presented. Following the selection of the cooking monitoring mode, the user selects "Next" and the screen shifts to a "Cook Timer" selection screen, a "Probe Temp" selection screen, or directly to a "Review" screen, depending upon the user's selection.

Figure 7:
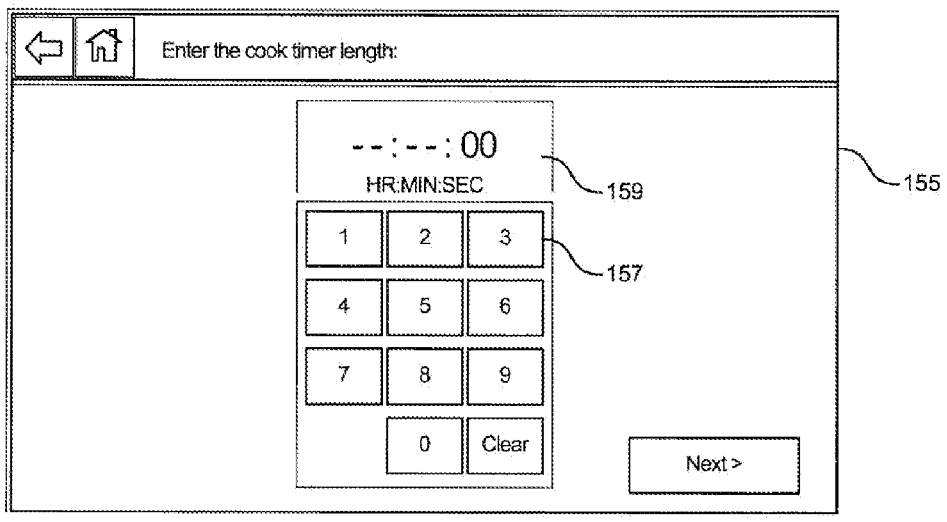
FIG. 7 is a plan view of a Timer Length Selection screen.

More specifically, if "Timer" 147 is selected from Monitoring Selection screen 145, display 57 changes to Cook Time Selection screen 155, as shown in FIG. 7, wherein a cook time for the cooking cycle is set. Cook Time Selection screen 155 preferably includes a plurality of numeric buttons 157 and a text display 159 for displaying a set cook time. Cook Time Selection screen 155 also includes a back button (shown as an arrow but not labeled) for returning a user to the previous screen and a home button (not labeled) for returning to a main menu screen. Additionally, a "Next" button is provided for activating a Review screen, which will be described in detail below in connection with FIG. 9.

Figure 8:
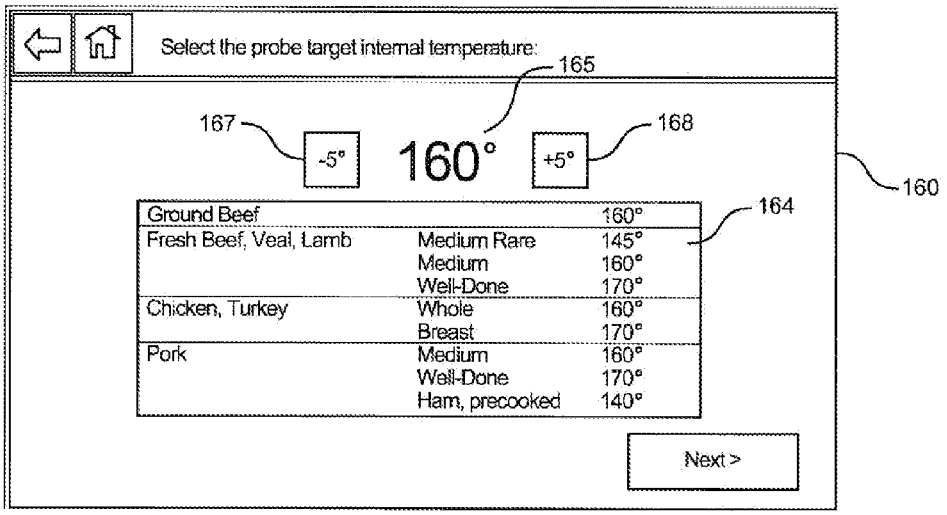
FIG. 8 is a plan view of a Probe Temperature Selection screen of the invention.
Figure 9:
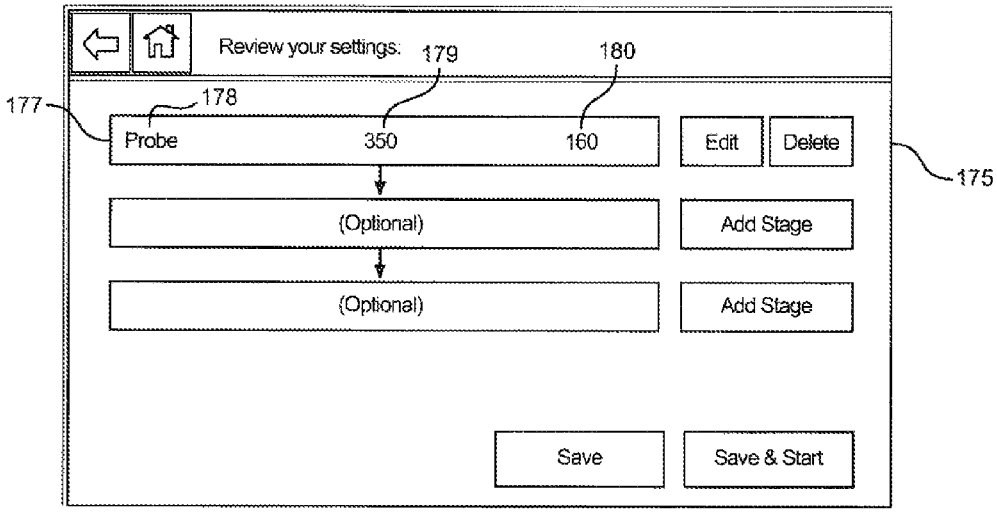
FIG. 9 is a plan view of a Review screen of the present invention.

If "Probe"148 is selected from Monitoring Selection screen 145, display 57 changes to Probe Target Selection screen 160, as shown in FIG. 8, wherein a probe target temperature is set for the cooking cycle. The Probe Target Selection screen 160 includes a reference table 164 displaying common types of meats with reference temperatures for medium rare, medium, and well-done. For example, table 164, as shown in FIG. 8, includes target temperatures for "Ground Beef", "Fresh Beef, Veal, Lamb, Chicken", "Turkey" and "Pork". A numeric temperature display 165 is located above reference table 164. In the embodiment shown, 160° F. is set as the default temperature on temperature display 165. A user may increase or decrease the temperature by touching the toggle buttons 167, 168 on either side of the default temperature. In the embodiment shown, the temperature is increased in 5° F. increments. Once the target probe temperature is set, the user touches "Next" to continue to the "Review" screen, as shown in FIG. 9.

Following the entry of a desired probe temperature on screen 160 or a desired cooking timer length on screen 155, a Review screen 175 is displayed such that a user can review the entered settings. Review screen 175 includes at least one row 177 having a selected mode field 178, selected oven temperature field 179 and a selected target probe temperature or timer length field 180. In the example shown, the selected mode field 178, as selected on Cooking Monitoring Selection screen 145, is "Probe". The selected oven temperature 179, as selected on Temperature Select screen 115, is 350°. The selected probe temperature 180, as selected on Probe Target Selection screen 160, is 160°. It should be understood that if the selected mode on Cooking Monitoring Selection screen 145 was "Timer", a timer length would be displayed in target probe temperature or timer length field 180. In addition, if no review method was selected from screen 145, field 180 would be blank. If the settings in row 177 are incorrect, the user may select "Edit" to return to the "Temperature Selection Screen". The user may also select "Delete" to remove the row completely. Additional cooking stages to establish a multi-stage cooking operation may be added by selecting "Add Stage" on screen 175. Upon the selection of "Add Stage", the Cooking Mode Selection screen 110 is displayed such that a user may begin entering values for an additional cooking stage. For example, a user may wish to bake lasagna for 40 minutes, broil it for 3 minutes to brown the top, and keep it warm for another 60 minutes until serving. Once all desired stages have been entered the user may select "Save" to save the settings or "Save and Start" to save the settings and begin the cooking operation.

Figure 10:
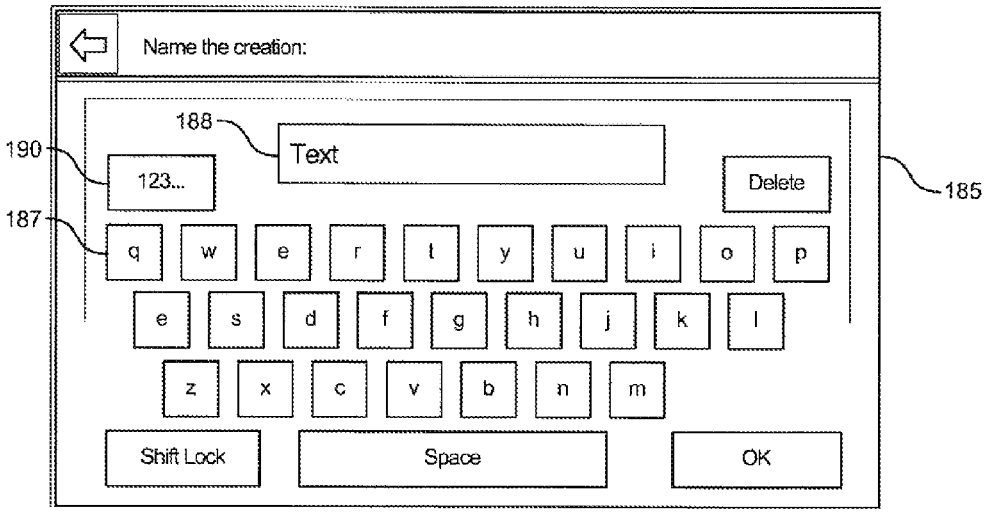
FIG. 10 is a plan view of a Save screen according to the present invention.

Following the selection of "Save" or "Save and Start", screen 175 shifts to Save screen 185, as shown in FIG. 10. Save screen 185 includes a letter keyboard 187 and a text entry field 188. A user may name the recipe creation by touching letters on letter keyboard 187, which are then displayed in text entry field 188. In addition, screen 185 includes a numerical switch key 190 for changing the letter keyboard into a numerical keyboard, such that numerals may be added into the creation name in text entry field 188. Delete, shift lock and space keys (not separately labeled) are also provided. Following the entry of the name of the creation, a user may select "OK" to complete the process of saving the creation. If "Save and Start" was previously selected from screen 175, display 57 shifts to a cooking status screen (not shown).

Figure 11:
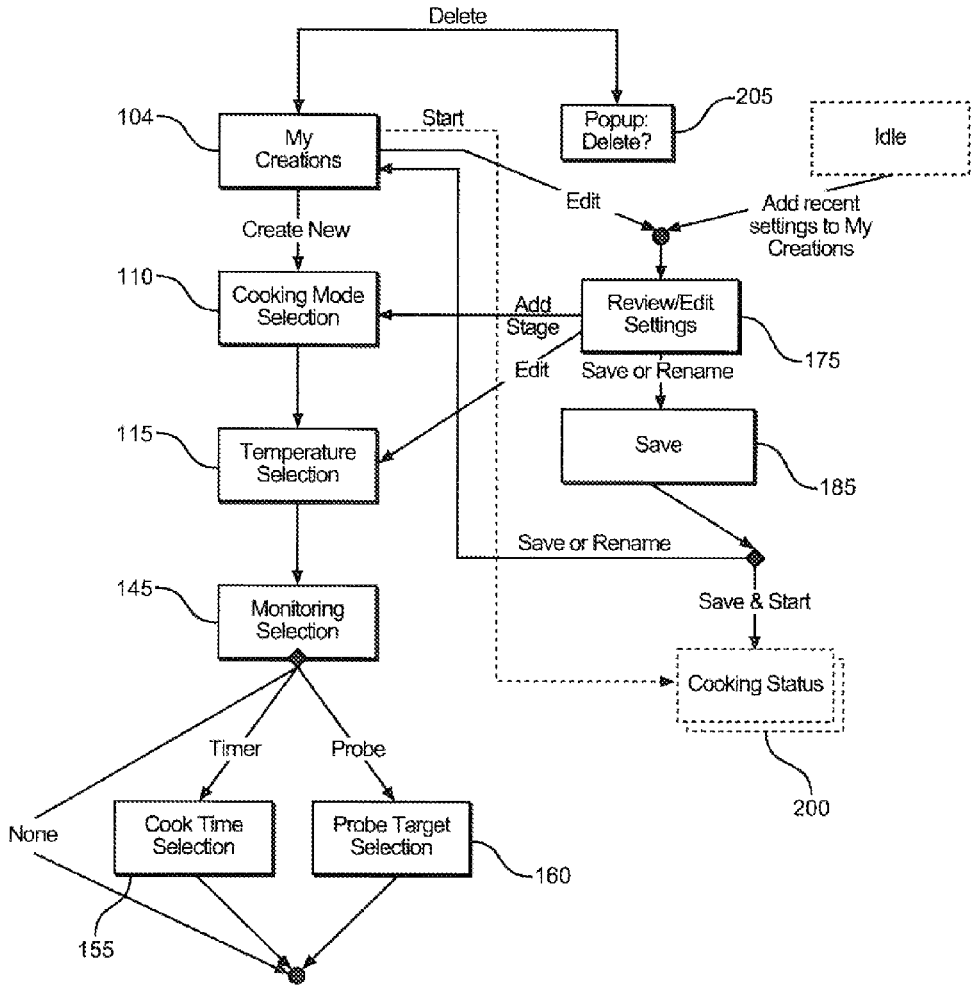
FIG. 11 is a programming flow chart depicting a method of controlling a cooking appliance in accordance with the present invention.

At this point the process for entering and saving cooking settings will be described with reference to the flow chart of FIG. 11. As described above, upon selecting "My Creations" from an Initial Selection screen 102, a user is presented with a "My Creations" screen 104, as indicated in the flow chart of FIG. 11. From screen 104, a user may start a cooking process based on a previously saved creation. Screen 104 will then change to a cooking status screen 200. Alternatively, a user may select Delete from screen 104 to delete a previously saved creation. A popup with the text "Delete?" will be displayed as shown in box 205. From screen 104, the user also has the option of selecting "Edit", which directs the user to the Review screen 175. In accordance with the present invention, a user may also select "Create New" from screen 104, which then shifts screen 104 to Cooking Mode Selection screen 110.

From Cooking Mode Selection screen 110, a user may select a variety of cooking modes as described above with reference to FIG. 4. Following the selection of a desired cooking mode, such as "Bake" or "Broil", screen 110 shifts to Temperature Selection screen 115. Once a desired cooking temperature is entered as described with reference to FIG. 5, screen 115 shifts to Cooking Monitoring Selection screen 145, wherein a user may select "Timer", "Probe" or "None" as a method of monitoring the cooking process. If "Timer" is selected, screen 145 shifts to Cook time Selection screen 155. Similarly, if "Probe" is selected, screen 145 shifts to Probe Target Selection screen 160. As discussed above, "None" may also be selected. Once a target probe temperature of cook timer length is selected, screens 155 or 160 shift to Review screen 175.

As described above with reference to FIG. 9, Review screen 175 includes options for a user to add additional settings by returning to Cooking Mode Selection screen 110. Review screen 175 also allows a user to Edit existing settings by returning to Temperature Selection screen 115. A user may also proceed to save the creation by proceeding to Save screen 185. From Save screen 185, a user may name or rename the creation using the letter keyboard or numerical keyboard as described in FIG. 10. If the user chooses to start the cooking operation following saving the creation, screen 185 shifts to a Cooking Status screen 200. In addition, recent settings may be added to My Creations by accessing Review screen 175 directly from an idle screen, such as clock screen 100.

Based on the above, it should be apparent that controller 55 and user interface 54, which function to prompt a user to input certain cooking information in a convenient and clear manner and then automatically control oven 10 to perform the desired operation, provide a user friendly system for controlling the operation of oven 10. In addition, oven 10 includes a display 57 for providing a user with simple method of saving multiple state cooking creations. The user is guided through the process of inputting creations in an easy-to-follow, step-by-step, manner. Thus, the likelihood of the cooked food product will be the desired product is greatly increased.

Although described with reference to preferred embodiments of the invention, it should be readily understood that various changes and/or modifications can be made to the invention without departing from the spirit thereof. For instance, although a combination radiant and convection system has been described, other cooking systems, such as a microwave system, could also be integrated into oven 10. In addition, although a touch screen control arrangement has been described, it would be possible to use a roller ball, arrow pointer similar to that available in various notebook-style computers and other types of control screen arrangements known in the art could be employed for this purpose. Therefore, the invention is only intended to be limited by the scope of the following claims.

We claim:

1. A method of programming a cooking appliance, including an oven cavity and a user interface, to execute a multi-stage recipe comprising:

a. presenting a user with a cooking mode selection screen for prompting a user to select a cooking mode;

b. receiving a cooking mode selection inputted into said user interface;

c. presenting a user with a cooking temperature selection screen for prompting a user to select a cooking temperature;

d. receiving a cooking temperature selection inputted into said user interface;

e. presenting a user with a monitoring method selection screen for prompting a user to select a method of monitoring a cooking process from at least a probe monitoring process and a timer monitoring process;

f. receiving a method of monitoring selection inputted into said user interface;

g. presenting a user with a review screen for prompting a user to review the cooking mode, cooking temperature and method of monitoring selections to establish a recipe; and h. presenting a user with a save screen for prompting the user to save the recipe.

2. The method according to claim 1, wherein said cooking modes include "Bake", "BakePlus", "Broil", "Keep Warm", "Convect Bake", "Convect Roast", "Convect Broil", "Convect Pastry", "Convect Frozen Pizza", "Convect Slow Roast", Proof" and "Rapid Proof."

3. The method according to claim 1, wherein said cooking temperature selection is made through a first virtual slide bar positionable by a user along a virtual track, wherein the virtual track includes temperature indicia at spaced intervals, and wherein sliding the virtual slide bar along the virtual track changes the cooking temperature in a text display field.

4. The method according to claim 1, wherein selections by the user are made through a touch screen.

5. The method according to claim 1, further comprising, when the method of monitoring selection is the probe monitoring process:

presenting a user with a probe monitoring selection screen; and receiving a probe target temperature inputted into said user interface.

6. The method according to claim 5, wherein said probe monitoring selection screen includes a guide table displaying common types of meats with reference cooking temperatures.

7. The method according to claim 1, further comprising, when the method of monitoring selection is the timer monitoring process:

presenting the user with a timer length selection screen; and receiving a timer length inputted into said user interface.

8. The method according to claim 7, wherein said timer length selection screen includes a plurality of numeric buttons and a text display for displaying a set cook time.

9. The method according to claim 1, further comprising: allowing a user to add additional stages to create a multi-stage recipe, including repeating steps a-g.

10. The method according to claim 9, wherein said save screen includes a plurality of letter and numerical keys for entering a name for the multi-stage recipe.

11. The method according to claim 9, wherein a cooking operation is automatically started after saving the multi-stage recipe, said cooking operation being executed based on said multi-stage recipe.

* * * * *